US005979854A

United States Patent [19]

Lundgren et al.

[11] Patent Number: 5,979,854

[45] Date of Patent: Nov. 9, 1999

[54] STRUT APPARATUS FOR HOLDING DRYWALL PANELS AND BUILDING MATERIALS IN POSITION

[76] Inventors: Curt Lundgren; Janet Lundgren, both of 51350 280th. St., Lancaster, Calif. 93536

[21] Appl. No.: 08/984,308

[22] Filed: Dec. 3, 1997

[51] Int. Cl.[6] ..... A47F 5/00

[52] U.S. Cl. ..... 248/354.3; 248/354.5

[58] Field of Search ..... 248/354.1, 354.5, 248/351, 408, 354.3, 354.4, 354.6; 52/121, 118; 414/11; 182/129, 97; 254/8 R, 108, 6 C, 98

[56] References Cited

U.S. PATENT DOCUMENTS

| | | | |
|---|---|---|---|
| 1,227,105 | 5/1917 | Barnes | 248/354.3 |
| 1,229,976 | 6/1917 | Klais | 248/354.5 |
| 1,513,252 | 10/1924 | Lampert | 248/354.3 |
| 1,730,618 | 10/1929 | Mayo | 248/354.5 |
| 1,832,782 | 11/1931 | Leupen | 248/354.5 |
| 2,291,170 | 7/1942 | Moths | 248/351 |
| 2,422,795 | 6/1947 | McKnight | 248/354.3 |
| 2,504,291 | 4/1950 | Alderfer | 254/354.3 |
| 2,535,141 | 12/1950 | Kenney et al. | 248/354 |
| 2,696,359 | 12/1954 | Hill | 248/354.3 |
| 2,746,706 | 5/1956 | Schneider | 248/354.5 |
| 2,861,767 | 11/1958 | Oves et al. | 248/351 |
| 2,937,842 | 5/1960 | Meek | 248/354.5 |
| 3,274,967 | 9/1966 | Igaue et al. | 248/354.5 |
| 3,356,330 | 12/1967 | Rambelle | 248/354.5 |
| 3,537,724 | 11/1970 | Matthews | 248/354.5 |
| 3,827,665 | 8/1974 | Kistler | 248/354 P |
| 3,877,191 | 4/1975 | Munsey | 52/632 |
| 3,910,421 | 10/1975 | Panneton | 214/1 SW |
| 3,930,645 | 1/1976 | Anderson | 269/289 |
| 4,027,802 | 6/1977 | Reynolds | 214/1 SW |
| 4,120,484 | 10/1978 | Zimmer | 254/6 C |
| 4,158,455 | 6/1979 | Brown | 269/102 |
| 4,221,362 | 9/1980 | Van Santen | 254/98 |

(List continued on next page.)

FOREIGN PATENT DOCUMENTS

| | | | |
|---|---|---|---|
| 510596 | 10/1952 | Belgium | 248/354.3 |
| 580100 | 4/1958 | Italy | 248/354.5 |
| 575489 | 12/1958 | Italy | 248/354.5 |
| 6502809 | 9/1966 | Netherlands | 248/354.4 |
| 741891 | 12/1955 | Sweden | 248/354 |
| 2260559A | 4/1993 | United Kingdom | 248/354.1 |

*Primary Examiner*—Derek J. Berger
*Assistant Examiner*—Michael Nornberg
*Attorney, Agent, or Firm*—Fulwider Patton Lee & Utecht, LLP

[57] ABSTRACT

The Building Material Installation Support Hand Tool of the present invention comprises a strut assembly having a horizontal support bracket disposed in a transverse, T-shaped arrangement with a vertical strut device. The strut device incorporates an elongated tube open at its top and bottom ends. The tube telescopically receives an upper extremity of a lower leg of the strut device for coarse adjustment of the height of the strut device to accommodate standard, predetermined heights of ceiling and wall structures. An adjustment means of the strut device interconnects the tube and the leg and is actuateable by the worker to releasably lock the tube in a position relative to the leg. The strut device includes at a lower extremity of the leg a cleat adapted to grip a floor. The cleat is attached to the leg by a screw jack which is threaded into the lower extremity of the leg which allows for a fine height adjustment of the strut device to accommodate small variations in the height of otherwise standard or non-standard predetermined heights of the ceiling or wall structures. Once the worker adjusts the strut assembly to the predetermined, standard height of the ceiling or the wall structure upon which building materials are to be installed, the strut assembly is purposely designed to be adjusted to an overall length which is greater than the predetermined height whereby the strut device is positioned at a small, oblique angle relative to the vertical plane when deployed to support the building materials.

6 Claims, 4 Drawing Sheets

U.S. PATENT DOCUMENTS

| | | | |
|---|---|---|---|
| 4,339,219 | 7/1982 | Lay | 414/11 |
| 4,375,934 | 3/1983 | Elliott | 414/11 |
| 4,482,130 | 11/1984 | Paredes | 254/8 R |
| 4,560,031 | 12/1985 | Dixon et al. | 182/129 |
| 4,576,354 | 3/1986 | Blessing, Sr. | 248/354.5 |
| 4,583,712 | 4/1986 | Wilks | 254/89 R |
| 4,589,622 | 5/1986 | Hutter | 248/354.4 |
| 4,600,348 | 7/1986 | Pettit | 414/11 |
| 4,682,460 | 7/1987 | Reetz | 52/632 |
| 4,695,028 | 9/1987 | Hunter | 248/354.1 |
| 4,709,527 | 12/1987 | Cooley | 52/749 |
| 4,733,844 | 3/1988 | Molloy | 248/354.1 |
| 4,766,710 | 8/1988 | Tompkins et al. | 52/278 |
| 4,867,403 | 9/1989 | Anderson | 248/355 |
| 4,868,943 | 9/1989 | Robichaud | 248/354.5 |
| 4,928,916 | 5/1990 | Molloy | 248/354.1 |
| 5,002,446 | 3/1991 | Anderson | 411/400 |
| 5,129,774 | 7/1992 | Balseiro et al. | 414/11 |
| 5,163,799 | 11/1992 | Lynn | 414/11 |
| 5,249,405 | 10/1993 | Miller | 52/712 |
| 5,322,403 | 6/1994 | Herde | 414/11 |
| 5,329,744 | 7/1994 | Sumter | 52/247 |
| 5,351,926 | 10/1994 | Moses | 248/354.5 |
| 5,368,429 | 11/1994 | Young | 414/11 |
| 5,407,183 | 4/1995 | Singeltary | 269/43 |
| 5,460,469 | 10/1995 | Young | 414/11 |
| 5,561,236 | 10/1996 | McKinney et al. | 52/127.2 |

FIG. 1
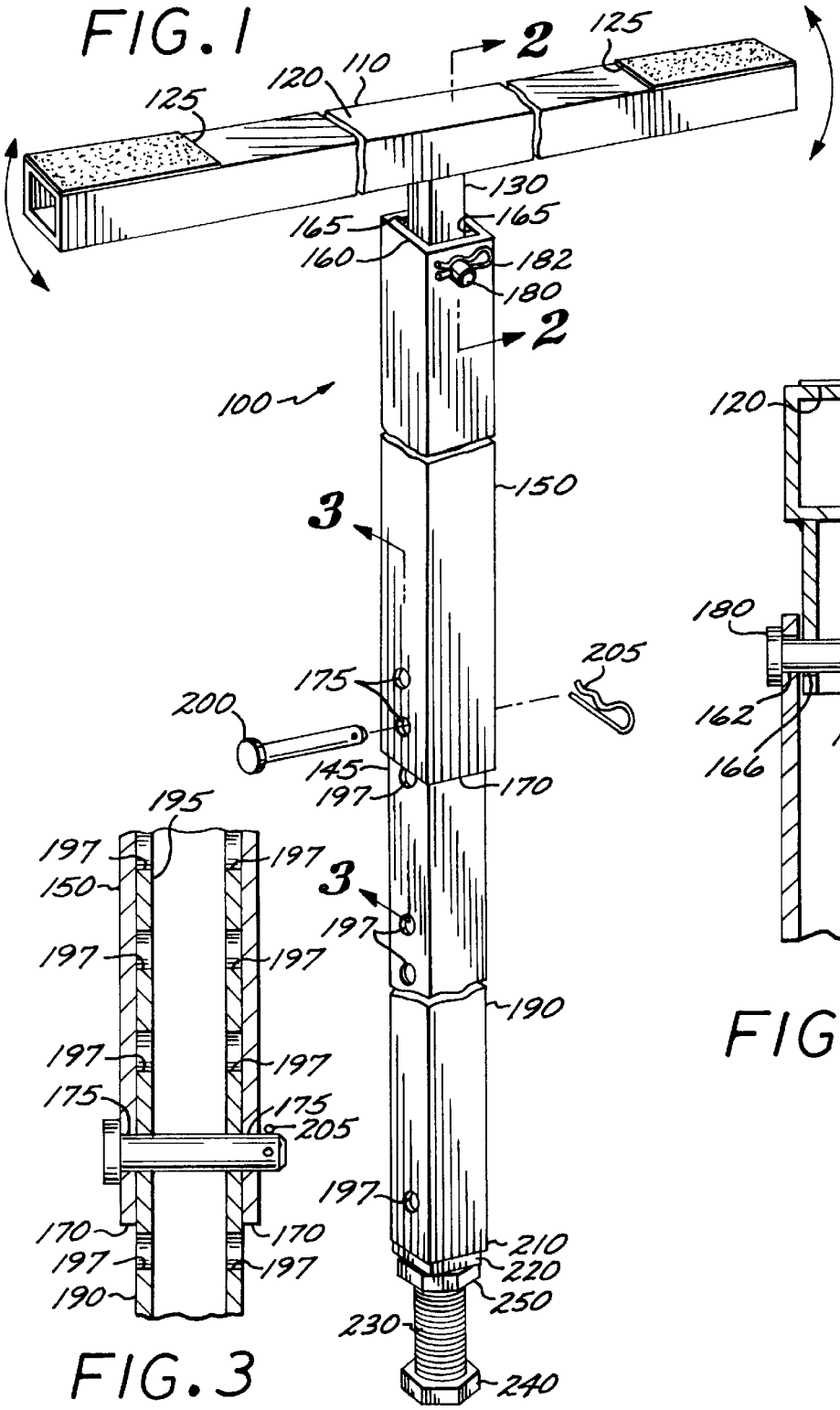
FIG. 3
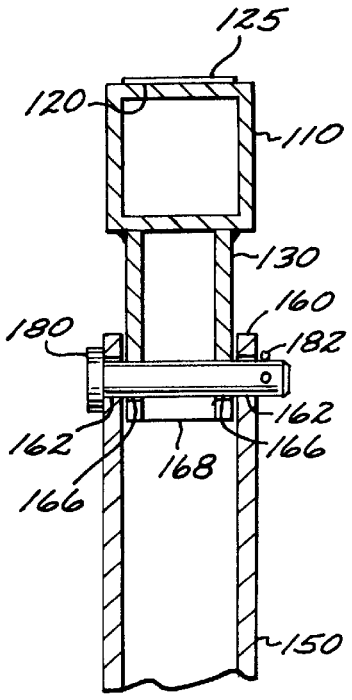
FIG. 2

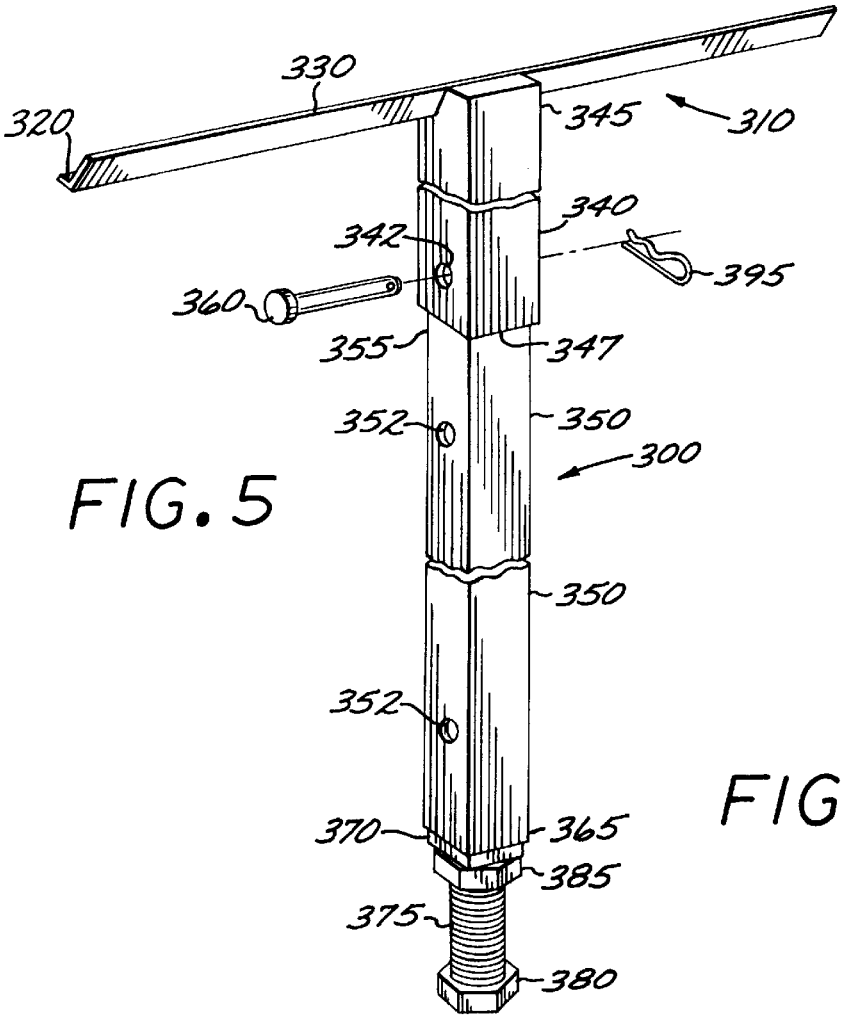
FIG. 5
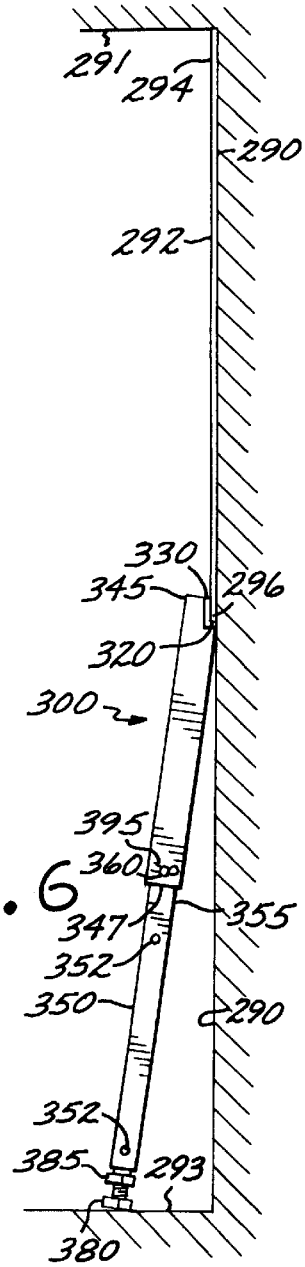
FIG. 6
FIG. 7
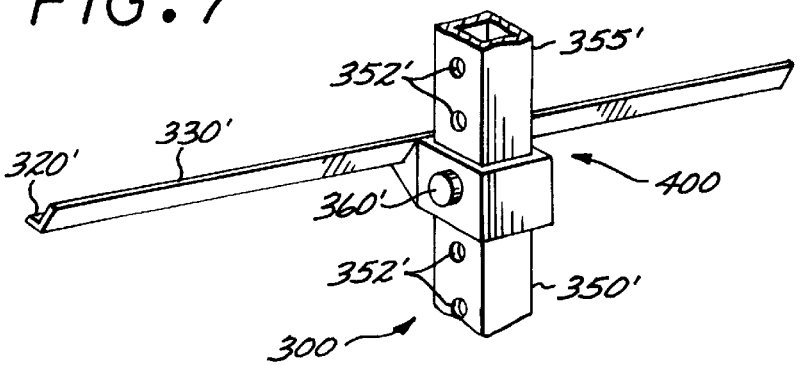

STRUT APPARATUS FOR HOLDING DRYWALL PANELS AND BUILDING MATERIALS IN POSITION

BACKGROUND OF THE INVENTION

1. Field of the Invention

The present invention relates to a manual building material installation support and more particularly to a temporary support tool for supporting dry wall panels or the like unaided by a worker while the worker secures such permanently in position on a ceiling or wall of a building structure.

2. Description of the Prior Art

Efforts have been made in the past to render the installation of building panels such as sheetrock or other wall or ceiling building panels more efficient. Typically, at least two workers are needed to lift a four foot by twelve foot panel of sheetrock into place and hold in position while driving fasteners such as nails and cleats into the frame of a wall or ceiling structure. The weight and the unwieldy size of typical panels render it impractical for workmen of normal size and strength to repeatedly lift panels into position and hold them while actuating a pneumatic screw gun throughout the length of a typical work day. Usually, at least two workers will cooperate to manually lift a panel of ceiling panel building material overhead and position the panel in place against a ceiling structure. Then, while they hold the panel in place they drive several fasteners through the panel and into the frame structure, to support the panel in position.

Since sheet rock panels might each weigh on the order of 70 or 80 pounds, it will be appreciated that a certain minimum number of fasteners will be necessary to hold the panel in position without assistance of the workman. This can give rise to several serious problems, particularly with relatively inexperienced workmen involved in drywalling various structures with differently spaced studs and joists and with drywall panels of different weights and thicknesses. For example, failure of the workmen to install a sufficient number of fasteners into the building material, oftentimes results in the fasteners, intended to temporarily hold the panel in place during the permanent installation process, pulling free thus allowing the panel to fall upon release thereof by the workmen, thus endangering the drywallers themselves as well as nearby craftsman. Typically, once the panel is lifted into place and temporarily supported with an adequate number of fasteners, the workers release their hand support or supporting tools and continue driving additional fasteners through the panel and into the ceiling structure until the panel is permanently installed. This task typically requires two workers because of the temporary nature of the installation. Until an adequate number of fasteners are installed, there is a risk of injury to workers or damage to the panel or nearby structures should the panel come loose and fall from the ceiling. These risks are lessened if two workers remain available to support the panel should it unexpectedly fall while temporarily supported. This is often accomplished by the worker prepositioning and holding several fasteners, usually drywall screws, in his mouth or teeth, then lifting the panel in place with the assistance of his co-worker, and holding the panel with one hand while using his free hand to handle a power drill adapted for screw installation of the screws. He may use his mouth or teeth to insert one screw into the power drill and then drive the screw into the overhead panel, repeating this procedure until a sufficient number of fasteners have been placed into the panel to permanently secure the panel in place. This method leads to several problems. Most notably, the worker will quickly experience considerable fatigue when installing heavy building materials and will require frequent rest periods. Also, the failure to install a sufficient number of fasteners into the panel to ensure adequate, temporary support before discontinuing manual hand support may cause to the panel to fall from the ceiling structure as mentioned. A failure to install a sufficient number of fasteners may be the result of many factors, including: an inaccurate estimation of the weight of the building material, worker fatigue requiring removal of the worker's supporting hand so that he may rest, an inadequate number of fasteners being pre-positioned in the mouth which requires him to remove a supporting hand to get more fasteners, or the loss of power to or the fastener from the power drill. Workers installing building materials onto wall structures have employed the same methods and experienced the same type of problems associated with the installation of building materials onto ceiling structures.

Some efforts have been made to develop devices designed to assist workers with the installation of building materials on ceilings and walls. For example, workers have been known to utilize work-site building materials such as two by fours fastened together in a T-shaped arrangement with a horizontal cross-member fastened to the top of a vertical member which is cut to a length sufficient to temporarily support building materials against the ceiling or the wall structure while permanent installation is accomplished. Using this method, the workers, first, lift and place the building material against the ceiling or wall structure. Next, while the first two workers continue holding the material in place, a third worker erects and places and the T-shaped support underneath either a downward facing surface or a bottom edge of the building material against either the respective ceiling or wall structure. Once the temporary support is in place, the workers may then release the building material which is temporarily supported by the T-shaped support. However, this approach has many pitfalls. First, the height of the vertical member may be inaccurately cut too short so that the overhead or wall panel is balanced on the support and inadequately supported. Second, the fasteners connecting the cross-member protrude from the top of the member such that they may cause gouging or abrasion damage to the building materials when the T-shaped support is erected. Third, the cross and vertical members may tend to separate from one another during repeated use causing the brace to become unstable and unsatisfactory for continued use. The device is also unsatisfactory for installation of panels on ceiling and wall structures of differing heights as the vertical member must be recut to size or replaced for each installation situation. Also, aside from the above-mentioned disadvantages of using miscellaneous building site materials to construct temporary supports, such as two by fours and similar materials, use of such materials results in increased waste of building materials slated for other construction site purposes.

Attempts to eliminate the disadvantages such as, unnecessary construction site waste, and the need for multiple workers associated with the above described methods and devices, have led to the development of more sophisticated temporary support devices for aiding in the installation of building materials. Certain of these support devices have been designed to assist the workers in lifting building materials to the desired height and supporting the materials in a desired position until fasteners have been installed to permanently secure the materials in place against a ceiling or wall structure. Other support devices have been employed which do not assist in lifting the materials into position, but instead merely temporarily support the materials in place after they have been lifted into place and positioned by the workers. U.S. Pat. Nos. 3,910,421 to Panneton and 4,560,031 to Dixon et al. appear to disclose devices which aid in the lifting and support of ceiling panels. U.S. Pat. Nos. 4,375,934 to Elliott, 4,576,354 to Blessing, Sr., 4,695,028 to Hunter, 4,733,844 to Molloy, 4,928,916 to Molloy, 5,129,774 to Balseiro et al., and U.S. Pat. No. 5,329,744 to Sumter seem to disclose devices which aid in the support of ceiling panels once the panels have been lifted into position.

Devices such as those disclosed in the above-listed patents are undesirable to the worker because their use increases the difficulty encountered during installation of building materials onto ceiling and wall structures in addition to creating many inefficiencies and disadvantages for the worker. For example, some of these devices are incapable of use in smaller, confined work areas due to their considerable size. Other devices appear to be comprised of a large number of mechanisms and moving parts which add significant weight, complexity and failure points to the support device. It is preferable to employ light-weight devices which do not add to the burden of installing building materials which materials can themselves be extremely heavy as, for example, four foot by twelve foot, double sheet-rock panels. Many of the devices discussed in the prior art comprise devices which appear to be heavier than the heaviest building materials used in constructing ceilings and walls. Those devices which incorporate multiple vertical support members are particularly cumbersome to use for the common practice of installing multiple panels of ceiling or wall building materials onto respective ceiling or wall structures because the vertical support members must each be positioned, removed and replaced for each panel. Other devices in the prior art have many moving parts including gears and springs. Use of gears and springs creates many potential problems for workers. The gears may seize up and jam when exposed to common but troublesome worksite elements including sawdust, metal shavings, nails, staples and other debris. Springs experience, fatigue wear and deterioration after continued use and may even break in certain shock loading situations rendering the support device useless. Additionally, springs must be designed for a specific weight of building materials to be effective in temporarily restraining the building materials in position during installation. The prior art devices do not teach a means of accommodating the various loads corresponding to the various types of building materials. Additionally, the springs are designed to be compressed during installation of the support devices such that the worker can never be certain whether the building materials are positively supported with a force sufficient to prevent unwanted release of the building materials from the temporarily supported position. Further, the use of the compression springs in the devices does not provide the worker with positive feedback indicating that the support device is in the intended supporting orientation. The worker is forced to rely on an often times unreliable visual indication of whether the support device is properly oriented.

The gears and springs described above are often employed in conjunction with various types of jacking mechanisms which serve either to assist the worker in lifting the panel into the desired position for installation or to extend the overall length of the support device to support the panel or both. The use of the jacking mechanisms is also undesirable to the worker because it requires an additional hand to actuate a handle of the jacking mechanism. Typically, the worker employs one hand to lift and hold the building materials into position and the other hand to position and hold the support device in a vertical position leaving no means by which the jacking handle may be actuated without the aid of an additional worker. Even if the worker uses one hand to support the panel overhead, and the other hand to position the support device and then to actuate the jacking handle, such actions create difficulties in the event that actuation of the jacking handle dislodges the support device from the vertical position. Dislodgement may still occur even if the third worker was employed to erect the support device and actuate the jacking mechanism. Dislodgment of the support device is especially likely in the event the jacking mechanism jams or seizes during actuation due to the inevitable efforts of the workers to unseize or unjam the mechanism. These support devices which employ jacking mechanisms are also cumbersome and unwieldy to use for the installation of various types of building materials where the support device must be positioned, its length extended with a jacking mechanism, removed and then replaced again for installation of the next panel.

Previous devices have failed to adequately assist workers with a hand tool capable of properly supporting building materials during construction of ceilings and walls and other similar structures. Thus, what is needed by the art and has been heretofore unavailable, is a device which aids the worker in the installation of building materials and which particularly is: lightweight; durable; comprised by a minimal number of moving parts subject to wear or damage; capable of quick and easy transport, assembly, disassembly; capable of storage in small spaces; quickly and easily adjustable to multiple, predetermined heights; secured easily into a supporting position with a single-hand of a single worker; and which is easily removed and reinstalled for the repeated installation of building materials such as, for example, multiple ceiling or wall panels.

SUMMARY OF THE INVENTION

The drywall strut apparatus of the present invention is intended to temporarily support ceiling or wall panels, placed against a ceiling or wall frame, while a worker installs fasteners to secure the materials to the respective ceiling or wall structure. Ceiling or wall panels of this type include single or double sheets of drywall, wallboard or sheetrock, plyboard panels and many different types of similar materials which are readily available in sheet form.

The strut apparatus of the present invention is characterized by a hollow tube which may be square in cross section and receives telescopically into its lower end a complementary shaped leg which may be adjusted to a selected telescopic relationship for course adjustment to adjust the overall height of the apparatus. A T-bar assembly is formed with a transversely extending cross bar, bracket or member for support of the drywall panel and includes a downwardly projecting stem for telescopic receipt in the top end in the hollow tube. The T-bar may be connected to the top end of the tube by means of a swivel joint allowing the T-member to remain in a horizontal position abutted upwardly against the bottom side of a panel being installed on a ceiling frame as the leg member is pivoted into generally vertical position there below. A foot member or cleat is screwed into the lower extremity of the leg and arranged for fine adjustment of the overall height to thereby provide for relatively exact height adjustment.

In another embodiment, the strut apparatus assembly has a horizontal support bracket with an upper support surface which is disposed in a transverse, T-shaped arrangement with a vertical strut device. The strut device further includes an elongated tube open at its top and bottom ends adapted to telescopically receive within its open bottom end an upper extremity of a lower leg of the strut device. The telescopic arrangement provides for coarse adjustment of the height of the strut device to accommodate standard or non-standard predetermined heights of ceiling and wall structures. An adjustment means of the strut device interconnects the tube and the leg and is actuatable to releasably lock the tube in a position relative to the leg. The strut device includes, at a lower extremity of the leg, a cleat adapted to grip a floor. The cleat is interconnected to the leg by a screw jack which is threadably received into the lower extremity of the leg. Fine height adjustment of the strut device is achieved by this configuration to accommodate small variations in the height of the standard or non-standard, predetermined heights of the ceiling or wall structures. Once the worker has adjusted the strut assembly to the desired standard or non-standard predetermined height of the ceiling or the wall structure, the strut assembly will by design, have an overall length which is greater than the predetermined height. By having such a greater length the strut device will be positioned at a small, oblique angle relative to a vertical plane when the strut assembly is deployed to support the building materials. After adjustment of the strut assembly, workers lift the building materials into the desired position and then place the horizontal, or transversely extending, upper support surface of the support bracket beneath either the downwardly facing surface of the materials to be mounted to the ceiling structure or beneath the bottom edge of the materials to be secured to the wall structure. Thereafter, the cleat of the strut's leg is driven snugly into place by the worker using his foot. The strut assembly will then be securely positioned to support the building materials.

BRIEF DESCRIPTION OF THE DRAWINGS

FIG. 1 is a broken perspective view of a drywall strut apparatus embodying the present invention;

FIG. 2 is a cross-sectional view in enlarged scale, taken along section line 2—2, showing the Installation Support Hand Tool of FIG. 1;

FIG. 3 is a cross-sectional view in enlarged scale, taken along section line 3—3 of FIG. 1;

FIG. 5 is a broken perspective view of second embodiment of the strut apparatus of the present invention;

FIG. 6 is a side view, in reduced scale, of the strut apparatus shown in FIG. 5;

FIG. 7 is a perspective view of a third embodiment of the strut apparatus of the present invention.

DETAILED DESCRIPTION OF A PREFERRED EMBODIMENT

Figure 4:
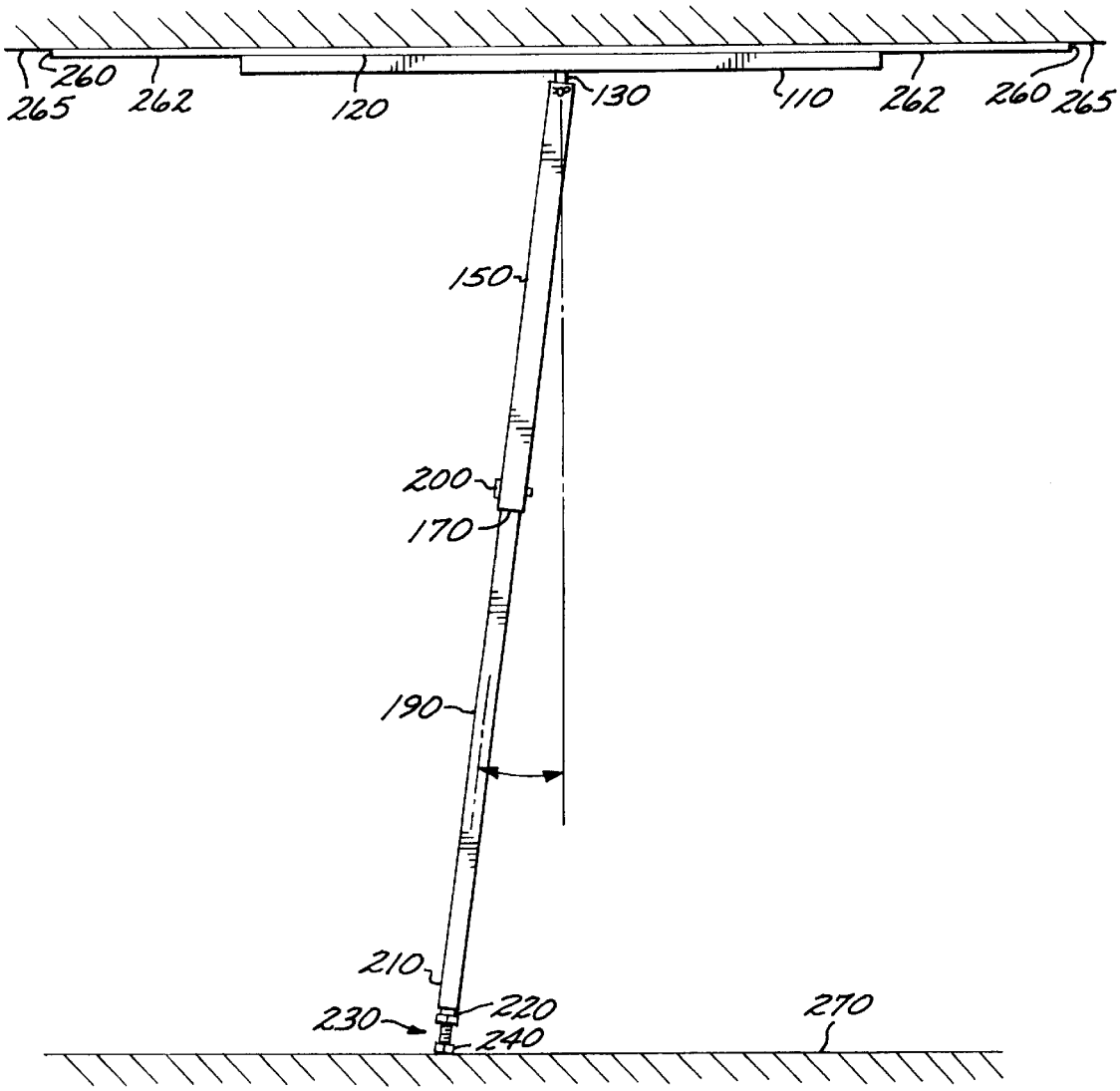
FIG. 4 is a front planar view, in reduced scale, of the Installation Support Hand Tool in FIG. 1 placed beneath building material.

As shown in the drawings for purposes of illustration, the present invention comprises a Building Material Installation Support Hand Tool which obviates many of the problems associated with installing building panels, such as sheet rock, drywall, wall panels, wallboards and ceiling panels, onto wall or ceiling structures. The shortcomings encountered with prior art building material installation devices are easily solved by the invention disclosed herein which is of a lightweight, heavy-duty construction and consists of a minimal number of moving parts which are subject to wear and damage. Additionally, the preferred embodiment of the present invention is capable of quick and easy assembly and disassembly for transport and storage in small spaces. Further, it can be quickly and easily adjusted to multiple, predetermined heights, secured into a supporting position, removed, and reinstalled by a single worker.

One object of this invention is to provide temporary support for the building materials so that the worker may permanently install the materials without the aid of an additional worker during the permanent installation process to free the additional worker to perform other tasks.

Another object of the invention is to provide a more reliable and durable support apparatus which efficiently overcomes the above-described shortcomings of the prior art devices without the need for complicated mechanisms.

It is a further object of this invention to provide a device which is easily and quickly assembled, adjusted, securely installed for temporary support of building materials, removed, disassembled, transported and stored.

Additional novel features, advantages over previous devices and objects of the inventor will become readily apparent from the embodiments described by the following detailed description of the invention when considered in conjunction with the accompanying drawings.

Referring to FIG. 1, the strut apparatus generally designated 100 of the present invention includes a laterally extending, horizontal support or cross bracket 110 with an upper support surface 120 having at least one anti-skid pad 125 affixed thereon. The horizontal support bracket 110 is formed in a generally T-shaped configuration with a rigid, vertical pivot stem 130 which projects medially from a lower portion or downwardly facing side of the bracket 110.

An elongated tube 150 is formed with an open top end 160 having oppositely disposed, side stop edges 165 and an open bottom end 170. The tube 150 includes a lateral hole 162 proximal to the top end 160 cooperating to form an interconnecting means for pivotally engaging the bracket 110 with the tube 150. As can be understood from FIG. 2, the pivot stem 130 is dimensioned relative to the tube 150 to be loosely and pivotally received into the open top end 160 enabling the tube 150 to tilt relative to the stem 130. The stem 130 is also adapted with a lateral bore 166 formed in its lower extremity 168. The lateral bore 166 of the stem 130 is configured to register hole 162 of the open top end 160 when the stem 130 is received within the open top end 160 so that a pivot pin 180 may be removably received within hole 162 and bore 166 to pivotally engage cross bracket 110 with tube 150. The pivot pin 180 is secured in position by a clip 182 or any of a number of other equally effective devices. In the preferred embodiment, the pivot pin passes completely through the tube 150 from one side to the other and is restrained by engagement of the clip 182 with an end of the pivot pin 180. FIG. 2 is a cross-sectional view further depicting this arrangement. Many equally suitable pivotable interconnect on devices are contemplated by the preferred embodiment. Such devices include, although not shown in the drawings, clevis-pin and various other types of pivotable, single or multiple degree of freedom and universal joints known to those having ordinary skill in the art. The stem 130 of bracket 110 is designed with its maximum outside dimensions to be smaller than the minimum internal dimensions of the open top end 160 of tube 150. This configuration causes the stem 130 to wobble within the open top end 160 about a transverse axis defined by the alignment of pivot pin 180 when pivotally received within the hole 162 and the bore 166. The range of wobble movement is limited as the tube 150 is tilted from one side to another about the transverse axis of the pivot pin 180 by side stop edges 165 which come into contact with corresponding sides of the stem 130.

The strut assembly 100 is further comprised by a lower leg 190 telescopically received at its upper extremity 195 into the open bottom end 170 of the tube 150 thereby cooperating to form a strut device of the assembly 100. The tube 150 and the leg 190 are releasably locked in position relative to one another by an adjustment device engageable between the tube 150 and the leg 190. In the preferred embodiment, at least one lateral bore 175 is formed in the tube 150 to register with at least one lateral hole 197 in the leg 190 to receive the adjustment device comprised in the present embodiment by a shear pin 200, which is retained within the hole 197 and the bore 175 by a retention clip 205. In the preferred embodiment, the shear pin 200 passes completely through the tube 150 from one side to the other and is restrained by engagement of the clip 205 with an end of the shear pin 200. FIG. 3 reflects a cross-sectional view further detailing this configuration. Many equally suitable adjustment devices 200 are contemplated by the preferred embodiment, including those which do not require the use of bores, holes and pins, and which are adaptable to perform the same function described herein. The preferred embodiment further contemplates a series of lateral bores 175 and lateral holes 197 configured to provide a coarse height adjustment of the strut assembly corresponding to standard or non-standard predetermined heights which are now, or may be in the future, prevalent in the construction industry for the fabrication of ceiling and wall structures. Such predetermined heights include, for example, eight and ten foot high ceilings and walls as measured from the floor or sub-flooring to the top of the wall structure or the bottom of the ceiling structure. This invention is intended to incorporate any number of possible hole and bore combinations enabling compatibility with a wide range of standard and non-standard predetermined heights. The strut assembly 100 of the present invention is configured to be adjusted, by use of the aforementioned holes, bores and adjustment device, to an overall length which is greater than the predetermined height such that when the strut assembly is installed to support the building material, the strut device will project from the support bracket 110 to the floor in a generally vertical direction, but with an oblique angle of approximately five degrees (5°) relative to a vertical plane for the reasons described in more detail below.

The lower leg 190 of the strut device has, mounted at its bottom end 210, an internally threaded nut 220, or other similarly threaded means, to threadably receive a screw jack 230 for fine height adjustments of the strut assembly 100 and to further cooperate with the tube 150 and the leg 190 in forming the strut device. Capability for fine adjustment ensures compatibility of the strut assembly 100 with structures designed to comply with standard predetermined heights, such as eight or ten foot ceilings and walls, but which structures may have heights less than or greater than the expected standard predetermined heights. Such variations may be due to normal accumulations of construction tolerances, unusual types of ceiling structures, thickness of flooring or subflooring, or construction errors. Additionally, the fine height adjustment capability of the screw jack 230 makes the strut assembly compatible for use with structures having non-standard, predetermined heights. The screw jack 230 further includes a foot member or cleat 240, integrally formed underneath the screw jack 230, for gripping the floor or sub-flooring. Threaded on the screw jack 230 is a locking nut 250 adapted to be reliably tightened against the bottom of the nut 220 to lock the screw jack 230 into position. The cleat 240 may be formed with an anti-skid material adapted to grip the floor without causing damage thereto or may be a hardened material intended to deform the sub-flooring.

Alternative embodiments of the above-described strut assembly 100 may include a modified support bracket, not shown but similar to support bracket 110 of FIG. 1, sized having sufficiently large internal dimensions so as to be capable of telescopic receipt of the tube 150 therein for storage purposes. In turn, leg 190 could then be fully received within and enveloped by tube 150. Thus, the modified support bracket would contain both the tube 150 and the leg 190 for extremely compact transport and storage capability.

In operation, the worker may assemble the strut assembly by inserting stem 130 of the support bracket 110 into the top open end 160 of the elongated tube 150. Once the bore 166 of the stem 130 is registered with the hole 162 of the tube 150, pivot pin 180 is inserted within hole 162 and bore 166. The worker may then telescope the upper extremity 195 of the leg 190 into the open bottom end 170 of the tube 150. After establishing the predetermined height of the ceiling structure above the floor, the worker then registers the corresponding lateral bore 197 with the corresponding lateral hole 175 and actuates or engages the adjustment device 200. The shear pin 200 of the preferred embodiment is then retained within the hole 175 and the bore 197 with retention clip 205. Having established the actual predetermined height, the worker then makes any required fine adjustment to the screw jack 230 to accommodate the above-described tolerance accumulation or construction error of the ceiling structure height above the floor and tightens lock nut 250 against nut 220, if desired.

In the embodiment of the ceiling strut apparatus 100, as represented schematically in FIG. 1, at least five lateral holes 197 are incorporated into leg 190 to correspond with the 5 predetermined ceiling heights most commonly used in the building construction trade. Specifically, such holes 197 are positioned on the leg 190 to each register with the lateral bore 175 such that the strut 100 has an overall length just greater than the above-described predetermined ceiling heights including, but not limited to, 7 feet and ¾ of an inch, 8 feet, 8 feet and ¾ of an inch, 8 feet and 4½ inches, and 10 feet.

With the strut assembly 100 prepared for installation, the worker enlists any required assistance from a second worker to lift the building material 260 into position against a ceiling structure 265 as shown in FIG. 4. While the material 260 is momentarily held in position by the workers, one of the workers uses a free hand to erect the strut assembly 100, as shown in FIG. 4, into position beneath a central portion of the building material 260 with the upper support surface 120 of the support bracket 110 disposed against the downwardly facing surface 262 of the building material 260. It is preferred for improved support capability that the longitudinal direction of the support bracket 110 is generally aligned with the longest length of the building material, if applicable. Next, with the strut device of the assembly 100 aligned in a nearly vertical direction, the worker drives the screw jack 230 into by tapping the jack 230 with his foot until the strut assembly 100 is rigidly secured into position gripping the floor 270 and with the supporting the building material 260. As previously described, the strut assembly 100 is purposely designed to have its overall length adjusted to be slightly greater than the predetermined distance between the ceiling structure 265 and the floor or subfloor 270. Due to the overall length being greater than the predetermined distance, the strut device cannot assume an exactly vertical or ninety degree (90°) orientation. Instead, it may only be driven into a nearly vertical, rigid securing position having an oblique angle of approximately five degrees (5°) relative to the vertical plane. This configuration gives positive tactile feedback to the worker that the strut assembly 100 is correctly oriented and secured without the need for the unreliable visual assessment as discussed earlier. The worker need only continue tapping the screw jack 230 until the jack ceases movement relative to the floor 270, in response to continued tapping with his foot or by other means such as a hammer, until he is assured that the strut assembly is properly oriented and securely fixed in position. The feedback to the worker results from the observation that no further movement of the screw jack 230 occurs relative to the floor 270 despite repeated attempts to drive the jack further by continued tapping with the foot. The worker may then discontinue manual support of the building material 260, as it will be temporarily secured in position by the strut assembly 100.

Once the building material 260 has been permanently secured to the ceiling structure 265, the worker may dislodge the strut assembly 100 from its rigid, supporting position by tapping the screw jack 230 in a reverse direction. The above procedure for installation and securing the strut assembly 100 is repeated as required for continued installation of additional building material. It can be understood from the above disclosure that the strut assembly 100 may be also be used for installation of building materials on ceiling structures which are not necessarily coplanar with the floor. The strut assembly may be readjusted to a different overall length to accommodate different predetermined heights as necessary. By reversing the sequence of above-described assembly steps, the strut assembly 100 may be disassembled for compact storage and transport between job sites.

Referring to FIGS. 5 and 6, additional alternative embodiments of the instant invention are shown which are adapted to facilitate installation of building materials to a generally vertical wall structure 290 using similar structural configurations and operational procedures as described above for the preferred embodiment. The building materials to be installed typically comprise a section of sheet rock, drywall or wallboard having a front face 292 with a transversely extending top edge 294 disposed at a point where the wall structure meets a ceiling structure 291. Below the top edge is a transversely extending, parallel bottom edge 296 disposed at a predetermined height above a floor or sub-floor structure 293. An alternative strut assembly is depicted generally in FIG. 5 by reference numeral 300. Being similar in construction to the preferred embodiment previously described, the strut assembly 300 is comprised by a transversely extending, angle bracket 310 formed with a horizontally projecting weight bearing flange 320 for supporting the bottom edge 296 and a vertically projecting pusher flange 330 for pushing against the front face 292. The angle bracket 310 is rigidly affixed medially to an elongated tube 340 at its top end 345. The tube 340 is also formed with an open bottom end 347.

The strut assembly 300 is further comprised by a lower leg 350 telescopically received at its upper extremity 355 into the open bottom end 347 of the tube 340 thereby cooperating to form a strut device of the assembly 300 similar to the previously described preferred embodiment. As with the preferred embodiment, the tube 340 and the leg 350 are releasably locked in position relative to one another by an adjustment device engageable between the tube 340 and the leg 350. An arrangement of lateral bores 342 formed in the tube 340 about opposite lateral sides and are disposed to register with lateral holes 352. The holes 352 are formed in a similar pattern in the leg 350 and disposed to receive an adjustment device 360, such as a shear pin which is retained with a retaining clip 395. Alignment of bores 342 with holes 352 enables coarse height adjustment of the strut assembly 300 to correspond with standard, predetermined heights of the bottom edge 296 above the floor 293. For example, use of a section of wallboard having a four foot lateral dimension between the top edge 294 and the bottom edge 296 in a building structure having eight foot ceilings would establish a predetermined height of approximately four feet between the bottom edge 296 and the floor 293. As before, this alternative embodiment is also configured to be adjusted to an overall length which is greater than the predetermined height, such that when the strut assembly 300 is installed to support the building material, the strut device will project from the weight bearing flange 320 to the floor 293 at a generally vertical, oblique angle of approximately five degrees (5°) relative to a vertical plane for the same reasons described in detail above in connection with the strut assembly 100 of the previously described embodiment.

In the embodiment of the wall strut assembly 300, as schematically shown in FIGS. 5 and 6, at least five lateral holes 352 are positioned on the leg 350 to each register with the bore 342 such that the wall strut 300 has an overall length just greater than the predetermined height of the bottom edge 296 of the wall panel 292. As with the ceiling strut 100, the bores 352 of the wall strut 300 correspond with the same, above-listed ceiling heights including, but not limited to, 7 feet and ¾ of an inch, 8 feet, 8 feet and ¾ of an inch, 8 feet and 4½ inches, and 10 feet.

The lower leg 350 of the strut device has, mounted at its bottom end 365, an internally threaded nut 370, or other similarly threaded means, to threadably receive a screw jack 375 for fine height adjustments of the strut assembly 300 and to further cooperate with the tube 340 and the leg 350 in forming the strut device. As with the preferred embodiment, the screw jack 375 of this alternative configuration further includes a foot member or cleat 380, integrally formed beneath the screw jack 375, for gripping the floor. Threaded on jack 375 is a locking nut 385. The cleat 380 may be formed in a similar manner as cleat 240.

In operation of this embodiment, as shown in FIG. 6, the worker may assemble the strut assembly in a similar fashion as described above. With the strut assembly 300 prepared for installation, the worker enlists any required assistance from a second worker to lift the building material, with its front face 292 facing outward, into position against the wall structure 290. While the material is momentarily held in position by the workers, one of the workers uses a free hand to erect the strut assembly 300 into position with weight flange 320 positioned below a central portion of the bottom edge 296 of the building material and with the pusher flange 330 pushing against the front face 292. Next, with the strut device of the assembly 300 aligned in a nearly vertical direction, the worker drives the cleat 380 of the screw jack 375 into place to grip the floor by tapping the jack with his foot until the strut assembly is rigidly secured into position supporting the building material. As previously described, the strut assembly 300 is purposely designed to have an overall length, when adjusted, which is length slightly greater than the predetermined distance between the bottom edge 296 and the floor 293. Being incapable of assuming an exactly vertical orientation, since the overall length is adjusted to be greater than the predetermined distance, the strut device can only driven into the rigid securing position having the oblique angle of orientation of approximately five degrees (5°) relative to the vertical plane. This configuration gives the same positive tactile feedback to the worker as with the previously described embodiment. Once the building material has been adequately secured to the wall structure, the worker may remove, readjust and replace the strut assembly 300 as required.

Alternative embodiments of the above-described ceiling and wall struts 100, 300 may manufactured with a simplified construction having the respective tubes 150, 340 and legs 190, 350 formed as a single, non-telescoping leg, not shown, to have an overall length compatible for use with any one of the above-described, predetermined ceiling or wall heights.

Figure 8:
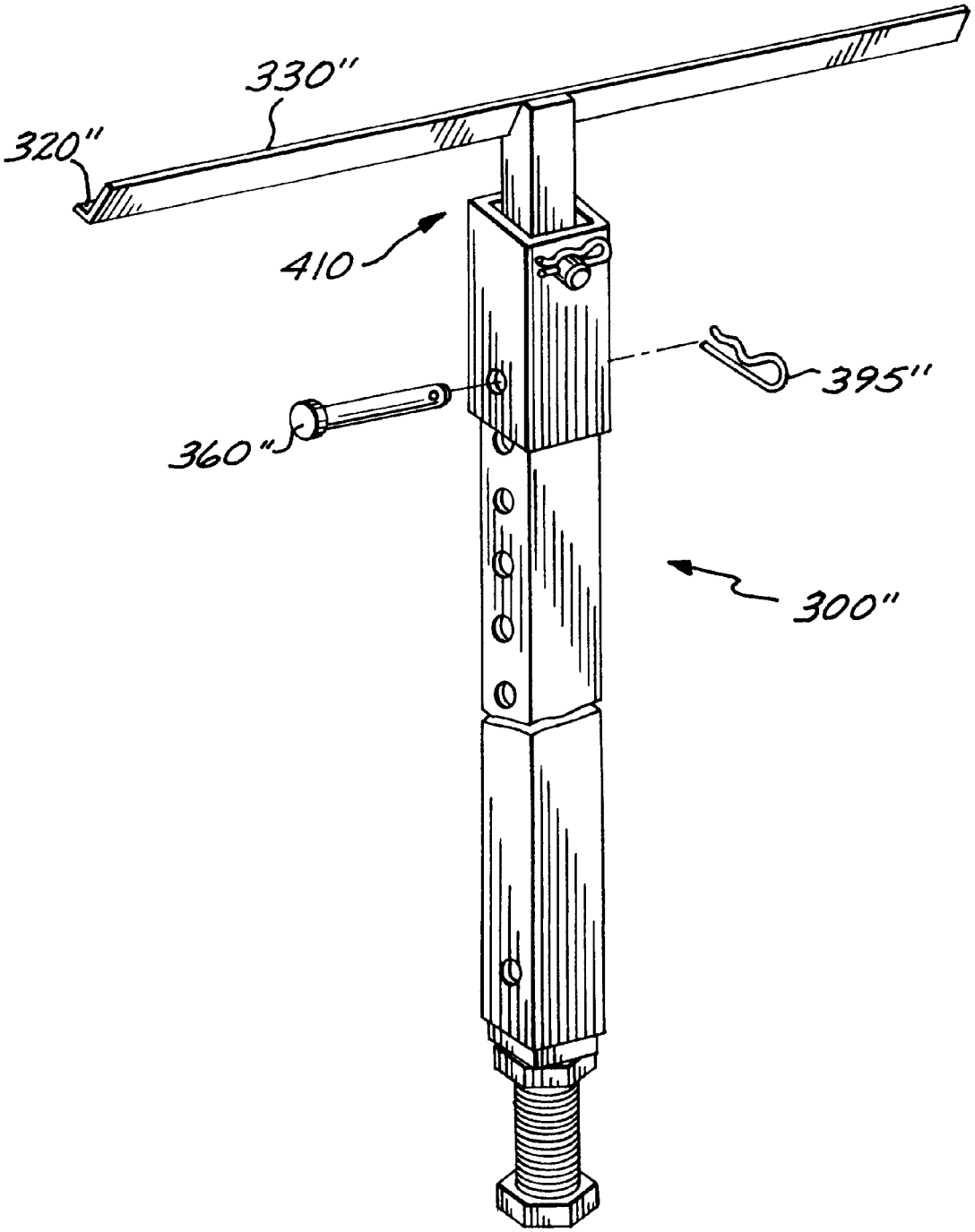
FIG. 8 is a perspective view of a fourth embodiment of the strut apparatus of the present invention.

Additional embodiments contemplated by this invention, as shown in FIGS. 7 and 8, include a modified angle bracket 400 and a different modified angle bracket 410, each of which could replace the fixed angle bracket 310 of the alternative embodiment shown in FIG. 5 to allow further flexibility in making the strut assembly 300' compatible with additional, standard or non-standard predetermined heights of wall structures.

While multiple forms of the invention have been illustrated and described, it is readily apparent that various modifications can be made without departing from the spirit and scope of the invention. For example, the brackets 110, 310, 400, 410, the stem 130, the tubes 150, 340, and the legs 190, 350, are preferably formed from a commonly available, drawn steel tube stock having a generally rectangular or square cross-section. However, many types of equivalent materials and cross-sectional configurations, including circular, may be substituted without departing significantly from the capability and intended objectives of the preferred embodiment. Similarly, the other above-described components are comprised by materials suitable for use with the above described structure and operation of the instant invention. The preceding description of the preferred embodiment and the best mode for practicing the invention are provided for illustration purposes only and not for the purpose of limitation; the invention being defined by the claims.

What is claimed is:

1. A strut assembly for wedgingly engaging the bottom surface of a generally planar building panel spaced at a predetermined distance above a floor to temporarily hold such panel in place for securement and comprising:

a transversely extending support bracket formed with an upper support face for engaging said bottom surface;

an elongated tube projecting downwardly from said bracket to form open top and bottom ends;

a leg telescopically received at its upper extremity into said open bottom end and threadably mounting at its lower end a screw jack having a floor gripping cleat for wedgingly engaging said floor at an oblique angle relative to a vertical plane, said leg and cleat cooperating with said tube to form a strut device, said leg being configured to be telescoped from said tube for a coarse adjustment and said cleat rotated to rotate said jack for a fine adjustment to set said strut device to space said support face a distance greater than said predetermined distance from said cleat;

an adjustment device engageable between said tube and said leg for releasably locking the position of said leg relative to said tube; and a pivot joint for connecting said support bracket to said tube for rotation of said strut device relative to said support bracket from a release position to a support position disposed at said oblique angle, said pivot including a stem projecting downwardly from said bracket and telescoped into said top end of said tube, a pivot pin projecting transversely through said tube and stem to provide for limited pivoting of said tube relative to said stem whereby a workman may adjust said adjustment device to establish a course pre-adjustment of said leg relative to said tube and adjust said screw jack for fine adjustment to form an overall length from said cleat to said support face greater than said predetermined distance so such workman may rotate said strut device about said pivot to said release position and then engage said face of said support bracket against said bottom surface of said building panel and rotate said strut device to said support position to wedgingly engage said cleat with said floor to position said strut device at said oblique angle to positively support said building panel on said strut assembly.

2. A strut assembly as set forth in claim 1 wherein:

said cleat is in the form of a hex nut.

3. A strut assembly as set forth in claim 1 that includes:

anti skid means mounted on said support face on top of said bracket.

4. A strut assembly as set forth in claim 1 for holding a panel in the form of a dry wall panel and wherein:

said bracket is configured with an uninterrupted planar top face defining said support face.

5. A strut assembly as set forth in claim 1 wherein:

said joint includes means for limiting the rotation of such strut device relative to said bracket.

6. A strut assembly as set forth in claim 1 wherein:

said joint includes interfitting tubular members and a pivot pin projecting horizontally therethrough, said tubular members being so configured as to cooperate with said pin for limiting rotation of said strut device relative to said bracket.

* * * * *